United States Patent [19]

von Bennigsen-Mackiewicz et al.

[11] 4,371,117

[45] Feb. 1, 1983

[54] PRODUCTION OF POWDERED SUGAR

[76] Inventors: Andreas von Bennigsen-Mackiewicz; Christoph von Bennigsen-Mackiewicz, both of 17, Mühlenstrasse, 3211 Banteln, Fed. Rep. of Germany

[21] Appl. No.: 248,751

[22] Filed: Mar. 30, 1981

Related U.S. Application Data

[63] Continuation of Ser. No. 53,170, Jun. 29, 1979, abandoned.

[51] Int. Cl.[3] ..... B02C 23/20

[52] U.S. Cl. ..... 241/18; 34/10; 99/516; 127/42; 127/63; 241/60

[58] Field of Search ..... 366/101, 106, 107; 423/DIG. 16; 34/10, 191; 99/474, 475, 516; 426/518; 241/15, 16, 60, 18, 19; 127/42, 63

[56] References Cited

U.S. PATENT DOCUMENTS

| | | | |
|---|---|---|---|
| 296,041 | 4/1884 | Niese et al. | 241/60 X |
| 3,047,275 | 7/1962 | Cox | 366/101 |
| 3,527,413 | 9/1970 | Crowther | 241/16 X |
| 3,731,393 | 5/1973 | Okada et al. | 34/10 |
| 4,021,927 | 5/1977 | Idaszak | 34/10 |
| 4,104,806 | 8/1978 | Reusch | 34/10 |

*Primary Examiner*—Mark Rosenbaum

*Attorney, Agent, or Firm*—William A. Drucker

[57] ABSTRACT

In a process for the production of powdered sugar, and an apparatus for carrying out the process, refined crystalline sugar is pulverized in a disintegrator positioned above a discharge hopper having filter walls to allow air to escape, the pulverized sugar being passed from a discharge hopper of the disintegrator into a fluidization unit in which the sugar is subjected to fluidization with air. Fluidization is then stopped, and the sugar is discharged.

11 Claims, 3 Drawing Figures

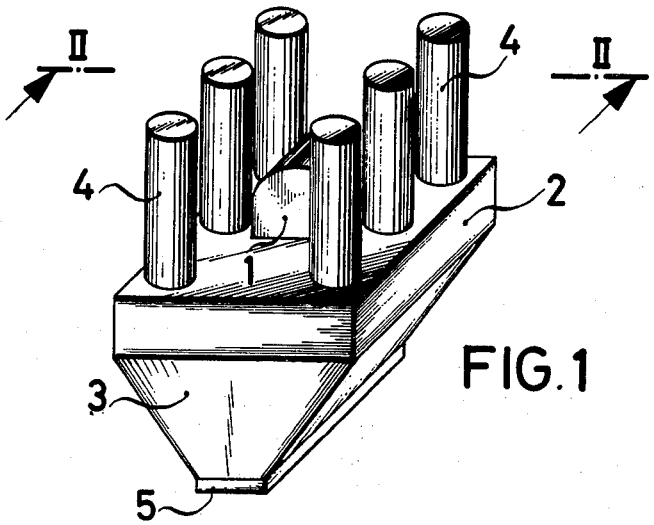
FIG. 1
FIG. 2
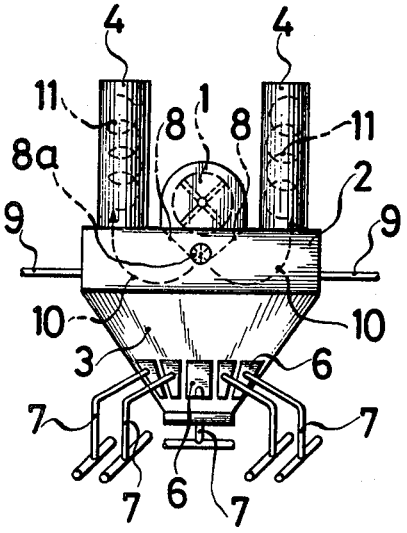
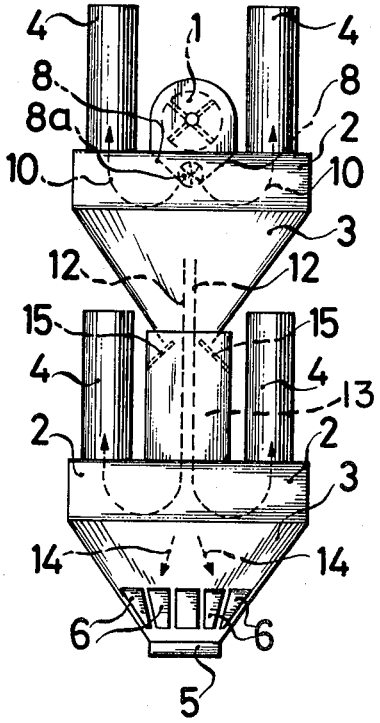
FIG. 3

PRODUCTION OF POWDERED SUGAR

This application is a Continuation of our application No. 53170 filed June 29, 1979, now abandoned.

BACKGROUND OF THE INVENTION

The present invention relates to a process and an apparatus, for the production of powdered sugar, in which refined sugar in crystals is pulverised in a disintegrator, the disintegrator being positioned above a discharge hopper which is equipped with filter walls to allow air to escape.

THE PRIOR ART

In a known process of this kind, the sugar pulverised in this manner is drawn off into preliminary storage containers, stored there for 24 hours and then packed into the actual sales containers. This intermediate storage is necessary because, by reason of the moisture content which is formed during disintegration the pulverised sugar becomes lumpy again after discharge from the discharge hopper and is not in a salesworthy condition as powdered sugar. By being repacked, the adhesion is broken down and the powdered sugar is brought into the final packing in a so-called stabilized condition.

The drawback in this known process is that intermediate storage is time-consuming and expensive and that in addition, with intermediate storage, the full powdered sugar qualities cannot always be attained, so that there is a relatively high wastage factor. With the known process, therefore, part of the intermediately stored sugar is returned to the refinery.

OBJECT OF THE INVENTION

The object of the invention therefore is to provide a process of the type first named above in which these drawbacks are avoided and which results very quickly and without waste in clean packing of powdered sugar, while guaranteeing the qualities of the powdered sugar.

SUMMARY OF THE INVENTION

This problem is solved according to the invention in that the pulverised sugar is taken from the discharge hopper of the disintegrator into a fluidization unit in which the sugar is subjected to fluidization with air for about 60 minutes. Then the fluidization is stopped and the sugar is discharged.

This process surprisingly ensures that, after this relatively short time, lumping of the sugar can no longer take place, so that after production the powdered sugar can be packed immediately in the final packing. In addition, the process according to the invention has the advantage that, unlike the known process, it makes pneumatic conveyance of free-flowing sugar possible, which is not the case with lumpy sugar.

It is particularly advantageous if, in apparatus for carrying out the process according to the invention, a fluidization apparatus is provided which consists of a fluidization container provided with at least one wall which is pervious to air but not to dust, the container being subjected to fluidization air and connected to the discharge hopper of the disintegrator by means of an air-tight connection. It is particularly suitable for the disintegrator to be positioned above the fluidization container so that its discharge hopper projects into the fluidization container by means of the insertion of a gate. It is a further advantage if the upper surface of the fluidization container has several filter tubes arranged on it in the form of hollow units which are pervious to air but not to dust and preferably consist of filter material stretched over a frame. With such filter tubes a relatively large filter surface is obtained. The filter tubes may have a circular cross-section, and therefore be hollow cylinders, whereas the fluidization container may have a circular or square cross-section.

It is a further advantage if, there are arranged, in the lower part of the fluidization container on its inner wall, individual fluidization surfaces subjected to fluidization air and consisting of material which is pervious to air, and said surfaces being arranged on the inner wall of a discharge tube of the fluidization container which is outwardly impervious to air, said surfaces preferably lying adjoining one another and side by side so that the total discharge area of the discharge tube of the fluidization container is ventilated.

To avoid the formation of bridges and chimneys, the individual fluidization surfaces can be subjected to fluidization air.

To improve further the fluidization results, two or more fluidization apparatuses may be placed one above the other with the discharge tube of the upper fluidization container, instead of the disintegrator, opening into the fluidization container beneath it.

To compensate for the lapse of time referred to above, it may also be advantageous if several, preferably two, fluidization devices are positioned side by side and brought into operation alternately.

The invention is described in more detail below with reference to the examples of embodiment shown in the accompanying drawing.

BRIEF DETAILS OF THE DRAWING

FIG. 1 shows a perspective view of one embodiment of the apparatus according to the invention for putting the process into effect;

FIG. 2 is a section taken on the line II—II in FIG. 1;

FIG. 3 is a section similar to FIG. 2 but in another embodiment of the device.

DESCRIPTION OF THE PREFERRED EMBODIMENTS

In FIG. 1, a disintegrator or powdering device 1 is positioned above a container 2 which is provided with a conical or truncated pyramidal discharge tube 3.

On the top of container 2 are positioned several filter tubes 4 which are pervious to air but not to dust and which consist of filter material stretched over an appropriately shaped frame. The extraction opening of the discharge tube 3 is referenced 5.

In FIG. 2, in the lower part of discharge tube 3 of fluidization container 2, there are arranged several individual fluidization surfaces 6, fixed on the inner wall of the discharge tube 3 which is outwardly impervious to air. As can be seen in FIG. 2, the fluidization surfaces 6 are arranged side by side so that they largely adjoin one another so that the total discharge area of discharge tube 3 of fluidization container 2 is ventilated.

The fluidization surfaces 6 which are pervious to air on the inner side of the container are intermittently subjected to fluidization air for the purpose of avoiding the formation of bridges and chimneys. For this purpose, as is shown diagrammatically in FIG. 2, the fluidization air is brought to the fluidization surfaces 6 by individual pipes 7.

The mode of operation of the arrangement described is as follows:

The pulverised sugar coming from disintegrator 1 passes through a gate 8a and through a discharge tube 8 of the disintegrator 1 into the container 2. The disintegrator 1 and/or the container 2 may be subjected to fluidization air e.g. by tubes 9. Since the air escape takes place through the filter surfaces of filter tubes 4, the particles of pulverised sugar move approximately in the direction of arrows 10 into the filter tubes 4 where they are swirled and fluidized as is shown by lines 11 in FIG. 2.

After a specific fluidization time—in practice about 60 minutes—the air supply is stopped so that the fluidized powdered sugar drops from the filter tubes into the discharge tube 3 of the apparatus. For the purpose of production, fluidization surfaces 6 are moreover subjected, more or less simultaneously with the opening of extraction outlet 5, to the fluidization air so that even during the process of production fluidization is continued, thus favouring production.

In the embodiment shown in FIG. 3, two apparatuses according to FIG. 1 are placed one above the other. The lower device, instead of a disintegrator, has an inlet tube 13 with which discharge tube 3 of upper container 2 is directly connected. As may be seen in FIG. 3, with this assembly fluidization of the powdered sugar supplied by disintegrator 1 can take place either simultaneously or successively in both devices. Depending on whether a sealing flap 15 is provided on the lower end of discharge tube 3 of the upper device or not, fluidization takes place successively or simultaneously. When flap 15 is open, the sugar particles enter the lower device in the direction of arrows 12.

Production takes place, in the manner described, with movement in the direction of the arrows 14. At least the lower apparatus is provided with fluidization surfaces 6. Appropriate fluidization surfaces may also be provided in the upper apparatus.

Correspondingly, several of the apparatuses may be arranged side by side and brought into operation alternately.

We claim:

1. A process, for the production of dried powdered sugar, comprising:

(i) providing a powdering device, (ii) placing refined sugar in crystalline state in said powdering device, (iii) reducing the crystalline sugar to powder by operation of the powdering device, (iv) passing the powdered sugar directly and downwardly from the powdering device into a fluidizing chamber having filtration walls adapted to permit passage therethrough of air but not of powdered sugar, (v) retaining the powdered sugar suspended in the fluidizing chamber for a dwell period and, whilst said powdered sugar is in said chamber, passing air into said powdered sugar to cause it to be dried whilst being fluidized therein, the duration of the dwell period being selected to ensure total drying of the powder, (vi) temporarily terminating the passage of drying air into the fluidizinig chamber, and (vii) whilst the passage of air is temporarily terminated, removing the dried powdered sugar from the fluidizing chamber.

2. The process of claim 1 wherein said period is about 60 minutes.

3. The process of claim 1 including the steps of passing fluidizing gas into the disintegrator during the operation thereof and filtering the gas emanating from the disintegrator.

4. Apparatus for the production of dried, powdered sugar, comprising:

(a) means for powdering crystalline sugar (b) a discharge hopper positioned below said powdering means to receive powdered sugar falling thereinto by gravity, said hopper having a bottom opening, (c) an outlet control gate in the bottom opening of the hopper, (d) fluidization chamber means positioned below said discharge hopper and including a wall connected thereto in fluid-tight manner, the bottom opening of the discharge hopper communicating with an upper part of the fluidization chamber means, the fluidization chamber means including in its wall filter means permitting the passage of air but not of powdered sugar, (e) inlet means on the internal surface of said wall of the fluidization means, for the feeding of fluidization air, (f) operable closure means at a lower part of said fluidization chamber means, for release of said powdered sugar therefrom.

5. Apparatus, for the production of powdered sugar, comprising, in combination:

(i) a fluidization chamber having an inlet gate and including in its wall at least one zone which is permeable to air but not to powder, (ii) means for feeding fluidization air to said chamber through said at least one zone, (iii) a sugar-powdering device positioned above said fluidized chamber and including an outlet conduit connected in fluid-tight manner to said fluidization chamber, and (iv) a plurality of filter tubes mounted on the upper wall of said fluidization chamber and communicating with said chamber, said filter tubes being adapted to be permeable to air but not to powder.

6. Apparatus, as claimed in claim 5, wherein said filter tubes comprise a frame, and filter material stretched over said frame.

7. Apparatus, as claimed in claim 5, wherein said filter tubes are cylindrical and have their longitudinal central axis vertical.

8. Apparatus, as claimed in claim 5, wherein said fluidization chamber includes a lower wall portion having apertures therein, said apertures being each covered by an air permeable element secured on the internal face of said lower wall portion.

9. Apparatus, as claimed in claim 8, wherein said air permeable elements are adjacent to and in contact with each other.

10. Apparatus as claimed in claim 5, wherein there are a plurality of said zones which are permeable to air, and wherein said means for feeding fluidization air is arranged to feed each said zone independently.

11. Apparatus, for the production of powdered sugar, comprising in combination:

(a) a plurality of fluidization chambers positioned in stacked formation one above another, each fluidization chamber above a lowermost one communicating with the fluidization chamber next below, the lowermost one of said chambers including in its wall at least one zone which is permeable to air but not to powder, (b) means for feeding fluidization air to said lowermost chamber through said at least one zone, (c) an outlet gate for said lowermost fluidization chamber, (d) a sugar-powdering device positioned above an uppermost one of said fluidization chambers and including an outlet conduit connected in fluid-tight manner to said uppermost fluidization chamber, (e) a plurality of filter tubes mounted on an upper wall of each said fluidization chamber and communicating with said chamber, said filter tube being adapted to be permeable to air but not to powder.

* * * * *